US005548565A

United States Patent [19]

Aoyama et al.

[11] Patent Number: 5,548,565

[45] Date of Patent: Aug. 20, 1996

[54] TIMEPIECE DEVICE

[75] Inventors: Tetsuzo Aoyama, Misato; Yoshiyuki Hayami, Ageo, both of Japan

[73] Assignee: Mansei Kogyo Kabushiki Kaisha, Saitama-ken, Japan

[21] Appl. No.: 419,917

[22] Filed: Apr. 11, 1995

[30] Foreign Application Priority Data

Sep. 27, 1994 [JP] Japan ..... 6-231453

[51] Int. Cl.[6] ..... F21V 33/00; G04B 19/30

[52] U.S. Cl. ..... 368/227; 362/234; 362/103

[58] Field of Search ..... 368/223, 227; 362/234, 23, 103, 191, 802

[56] References Cited

U.S. PATENT DOCUMENTS

| | | | |
|---|---|---|---|
| 3,018,614 | 1/1962 | Brein | 368/223 |
| 3,681,587 | 8/1972 | Brien | 368/227 |
| 4,417,819 | 11/1983 | Migeon | 368/67 |
| 4,527,096 | 7/1985 | Kindlmann | 315/169.3 |
| 4,740,933 | 4/1988 | Brien | 368/67 |
| 4,775,964 | 10/1988 | Alessio et al. | 368/67 |
| 4,910,652 | 3/1990 | Rhine | 368/223 |
| 4,972,394 | 11/1990 | DiMarco | 368/227 |
| 5,265,071 | 11/1993 | Thorgersen et al. | 368/67 |

FOREIGN PATENT DOCUMENTS

| | | |
|---|---|---|
| 62-15032 | 4/1987 | Japan . |
| 2257591 | 10/1990 | Japan . |

*Primary Examiner*—Bernard Roskoski
*Attorney, Agent, or Firm*—Ladas & Parry

[57] ABSTRACT

Timepiece device capable of illuminating an outside object and providing an outstanding illuminating effect. A light-emitting diode of high-luminance and high directivity for illuminating the outside object is provided on the side of an outer case of a timepiece and the light-emitting direction is arranged parallel to a line passing through numerals 6 and 12 on the dial.

15 Claims, 6 Drawing Sheets

TIMEPIECE DEVICE

BACKGROUND OF THE INVENTION

1. Field of the Invention

This invention relates to a timepiece device for indicating the time, and more particularly to an improved illumination inside and outside the timepiece.

2. Description of the Prior Art

In a conventional comparatively large timepiece such as a wall clock and a table clock, there is provided a large dial to read the time, wherein it is possible to have comparatively free choice of a time indicating means or a dial illuminating means and for example, when an electric light segment display is used, it is possible to easily read the time even in the dark or from a distance. Also, in a timepiece of a digital display type using a liquid crystal display (hereinafter referred to as "LCD"), it is necessary to make the backlight put on to read the time in the dark.

Also, U.S. Pat. No. 4,775,964 entitled "Electroluminescent Dial For An Analog Watch And Process For Making" discloses an analog watch in which a dial is illuminated, by using an electroluminescent device (hereinafter referred to as "EL"), to enable reading the time in the dark.

As described above, it is known in the conventional timepiece that the LCD having the backlight, a light-emitting diode (hereinafter referred to as "LED") or the like is used as a time indicating means to enable reading the time in the dark and also as an illuminating means to illuminate the dial.

However, in the conventional timepiece, there is only provided an electrically light-emitting means which can produce a quantity of light in such an amount as to make it easy to read the time. The quantity of light is insufficient to illuminate an outside object. Accordingly, the electrically light-emitting means is not sufficient to serve for, for example, as a flashlight in case of searching for a keyhole in the dark.

It may be however possible in the timepiece provided with the EL to make an object to be illuminated visible to a certain extent by bringing the side of the dial near such object, but it is still not enough to produce sufficient light from the timepiece.

To drive the EL, it is necessary to convert a direct-current voltage of a cell built in the time piece to an alternating voltage through an inverter and supply the power to the EL. Exemplary patent specifications showing the driving circuit for the EL are seen in Japanese patent publication No. Sho. 62-15032 and U.S. Pat. No. 4,527,096.

When the EL is used for illuminating the dial, an illumination effect can not be obtained in practice if the EL is off in a moment after it is on. In this case, it is necessary to provide, for example, a timer function in the driving circuit which is adapted to maintain the "on" condition for a given period of time after an on/off switch for the EL is set.

SUMMARY OF THE INVENTION

It is therefore an object of the present invention to solve such problems of the conventional timepiece as described above, and thus provide an improved timepiece device which can illuminate an outside object and produce an outstanding illuminating effect even when an EL is used to illuminate a dial.

To achieve the objects and in accordance with the purpose of the present invention, there is provided a timepiece device in which a high-luminance and high-directivity LED for illuminating the outside object is formed on the side of a case.

The LED is preferably disposed on a side of the case near the numeral 9 on the dial of the analog time indication so that its light-emitting direction can be substantially parallel to the line passing through the numerals 6 and 12 on the dial.

Further, it is to be noted that an on-off switch for said LED may be provided on the case out of an optical path of the light emitted from the LED.

There are also preferably provided LED on the outer peripheral portion of the dial of analog time indication type for illuminating the dial and a light guiding member for guiding the light emitted from the LED to the surface of the dial.

Further, a timer may be provided to control the ON-time of at least one of an on-off switch for the LED for illuminating the outside object or an on-off switch for the LED for illuminating the dial.

A common switch may be provided both for the LED for illuminating the outside object and the LED for illuminating the dial.

Also, a light-emitting surface for a luminous body consisting of the EL (hereinafter referred to as "EL luminous body") is preferably provided on the reverse side of a dial of analog time indication type which is made of transparent material.

A timer may be provided to control the ON-time of at least one of the on-off switch for the LED for illuminating the outside object and the on-off switch for the EL luminous body.

A common switch may be provided both for the LED for illuminating the outside object and said EL luminous body.

Further, preferable drive circuit for the EL luminous body is an inverter circuit for capacitive load in which it is connected to a drain of an MOS·FET in common with emitters of two transistors forming the inverter circuit and a minus side of a battery is connected to a source of the MOS·FET and a plus side of the battery is connected to a gate of the MOS·FET through a switch.

The timepiece device according to the present invention is constructed as described above and the LED of high-luminance and high-directivity is used to illuminate the outside object. It is therefore possible for the high quantity of light to intensively illuminate the object to be illuminated in the dark, thereby improving the illuminating effect.

The LED is mounted on a side of the case near the numeral 9 on the dial of the analog time indication and its light-emitting direction is arranged to be substantially parallel to the line passing through the numerals 6 and 12 on the dial. So, when the LED is put on, for example, a wrist watch, it is possible to emit the light toward the subject to be illuminated without hindrance by hand and the like.

It is also to be noted that a switch for the LED is mounted so as not to interfere with the path of light to prevent the switch from providing a possible hindrance of the light-emission.

The LED and the light-guiding member for guiding the light emitted from the LED to the surface of the dial are provided at the outer periphery of the dial to illuminate the dial for easy reading of the time.

The dial is made of transparent material and the EL is mounted on the reverse of the dial. With this construction, the whole dial is brightened by the emission of the EL so that the time is read with ease.

The timer is provided to control the ON-time of at least one of the switches for the LED for illuminating the outside object, the LED for illuminating the dial, and the EL. Therefore, the illumination is maintained for a certain period of time after the switch is on, which improves recognizability of the time.

In the drive circuit of said EL, when the switch is on, the battery voltage is applied to the gate of the MOS-FET to have ON state and the two transistors forming the inverter circuit are operated to oscillate the circuit and the EL emits the light. At this time, even if the switch is switched off, the ON state is maintained for several seconds because a gate current of the MOS-FET is very small (several μA).

The above and other objects, features, and advantages of the invention will become more apparent from the following description when taken in conjunction with the accompanying drawings, in which:

DETAILED DESCRIPTION OF THE PREFERRED EMBODIMENTS

In order to provide a better understanding of the present invention, preferred embodiments will be described below with reference to the accompanying drawings.

Figure 1:
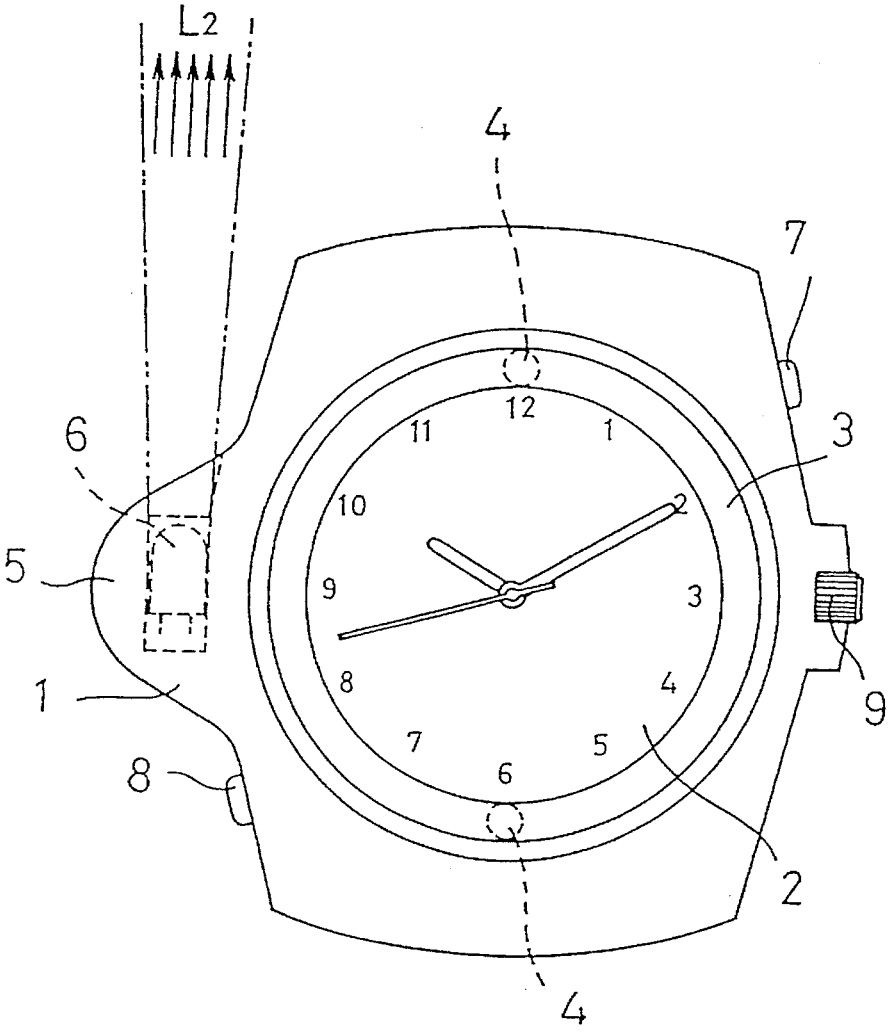
FIG.1 is a front view of a wrist watch body according to the first embodiment of a timepiece device of the present invention.

FIG. 1 is a front view of a wrist watch body according to the first embodiment of the present invention, wherein reference numeral 1 is an outer case, reference numeral 2 is a dial of analog indication type, at the center of which an hour hand, a minute hand and a second hand are rotatably mounted in the known manner, and time indicating indices are provided at the periphery of the dial 2. Reference numeral 3 is a light-guiding plate to be described below and reference numeral 4 designates a plurality of light-emitting diodes (2 pieces are shown in the drawing; hereinafter referred to as "LED") which are disposed under the light-guiding plate 3.

Reference numeral 5 is an LED mounting portion formed by projecting the outer case 1 on the side near the mumeral 9 on the dial and reference numeral 6 is an LED for illuminating an outside object which is mounted in the LED mounting portion 5 so that its light-emitting direction can be substantially parallel to the line passing through the numerals 6 and 12 on the dial. Reference numerals 7 and 8 are outer switch buttons which are mounted on the outer case 1 at portions near the numerals 2 and 8 on the dial and adapted to switch on or off the LED 4 for illuminating the dial 2 and the LED 6 for illuminating the outside object. Reference numeral 9 is a crown for setting the time.

Figure 2:
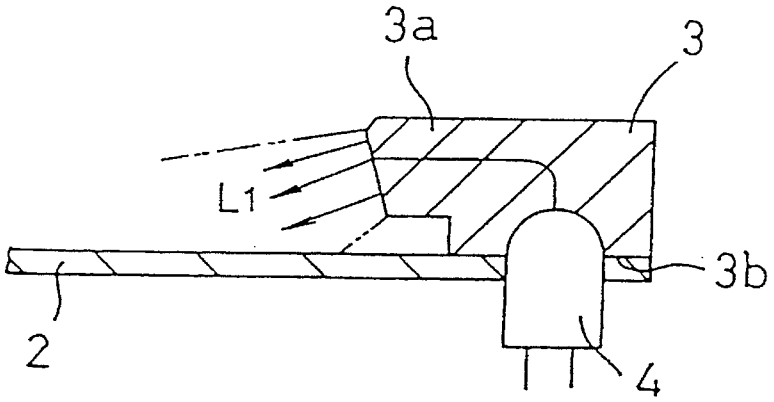
FIG.2 is an enlarged sectional view of a part of a light guiding plate of FIG. 1.

FIG. 2 is an enlarged sectional view of a part of said light-guiding plate 3. The light-guiding plate 3 is adapted to guide the light $L_1$ emitted from the LED 4 to the entire peripheral area of the dial 2 and is secured at the the outer peripheral portion of the dial 2 for illuminating the time indicating indices. The light-guiding plate 3 is also designed to have a substantially L-shaped form in its side elevation and the end surface of its horizontal portion **3*a* faces the surface of the dial 2 and it is further provided at the base portion of its vertical portion 3*b* with the LED 4**.

Figure 3:
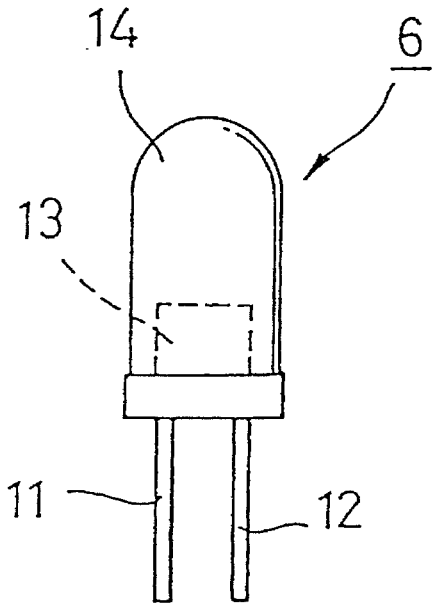
FIG. 3 is a front view of a LED for illuminating an outside object which is used in the present embodiment.

FIG. 3 is a front view of the LED 6 for illuminating the outside object. The LED 6 comprises an anode 11, a cathode 12, a light-emitting portion 13 and a lens portion 14 and has a high-luminance and a high directivity. The luminance of the LED for normal display and a pilot lamp is about several meters of candelas to tens of meters of candelas and its directivity is widened to have an angle of several tens of degrees. On the contrary, in the present embodiment, the luminance extends from hundreds of meters of candela to thousands of meters of candela (it is possible to have tens of thousands of meters of candela), while the directivity is controlled to have an angle of several degrees under the influence of the lens portion 14.

Figure 4:
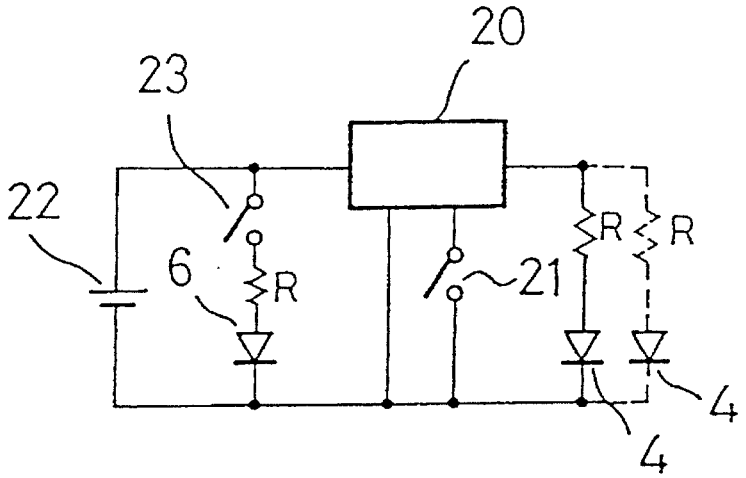
FIG. 4 is a circuit diagram showing one example of a drive circuit for the LED of the first embodiment.

FIG. 4 shows one example of a drive circuit for the LED 4 and 6. The LED 4 for illuminating the dial 2 is connected to a battery 22 through a timer 20 for controlling the LED ON-time and a first switch 21 connected to the first outer switch button 7, while the LED 6 for illuminating the outside object is connected to the battery 22 through a second switch 23 connected to the second outer switch button 8. Reference letter R shows resistors.

Figure 5:
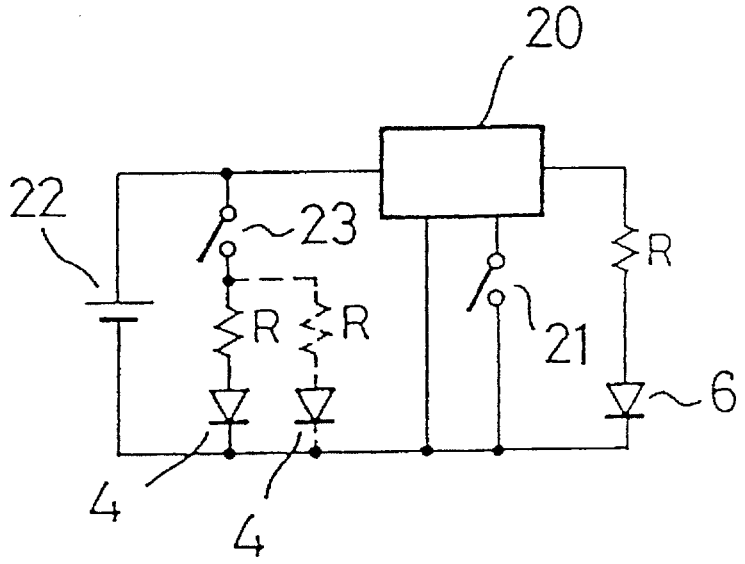
FIG. 5 is a circuit diagram showing another example of the drive circuit for the LED of the first embodiment.
Figure 6:
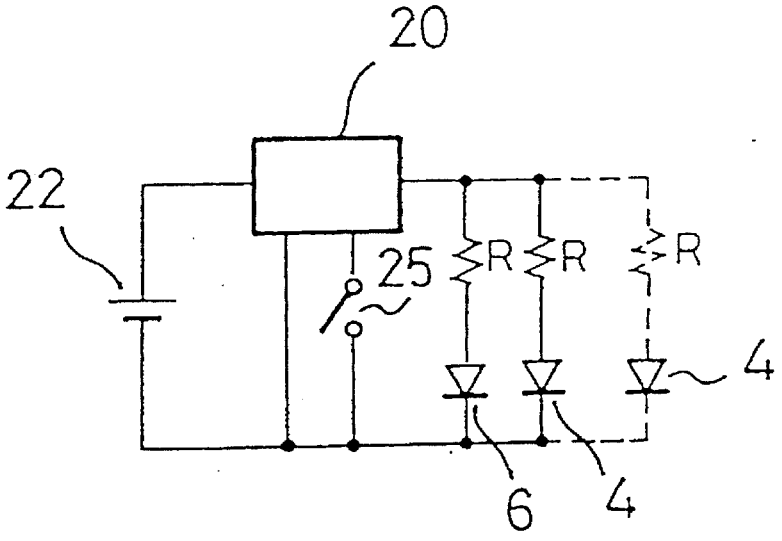
FIG. 6 is a circuit diagram showing another example of the drive circuit for the LED of the first embodiment.

FIGS. 5 and 6 show another example of the drive circuit for the LED 4 and 6. In the drive circuit of FIG. 5, the LED 4 for illuminating the dial is connected through the second switch 23 to the battery 22, while the LED 6 for illuminating the outside object is connected through the timer 20 and the first switch 21 to the battery 22.

On the other hand, in the drive circuit of FIG. 6, both LED 4 and 6 are connected through a common timer 20 and a common switch 25 to the battery 22.

Figure 7:
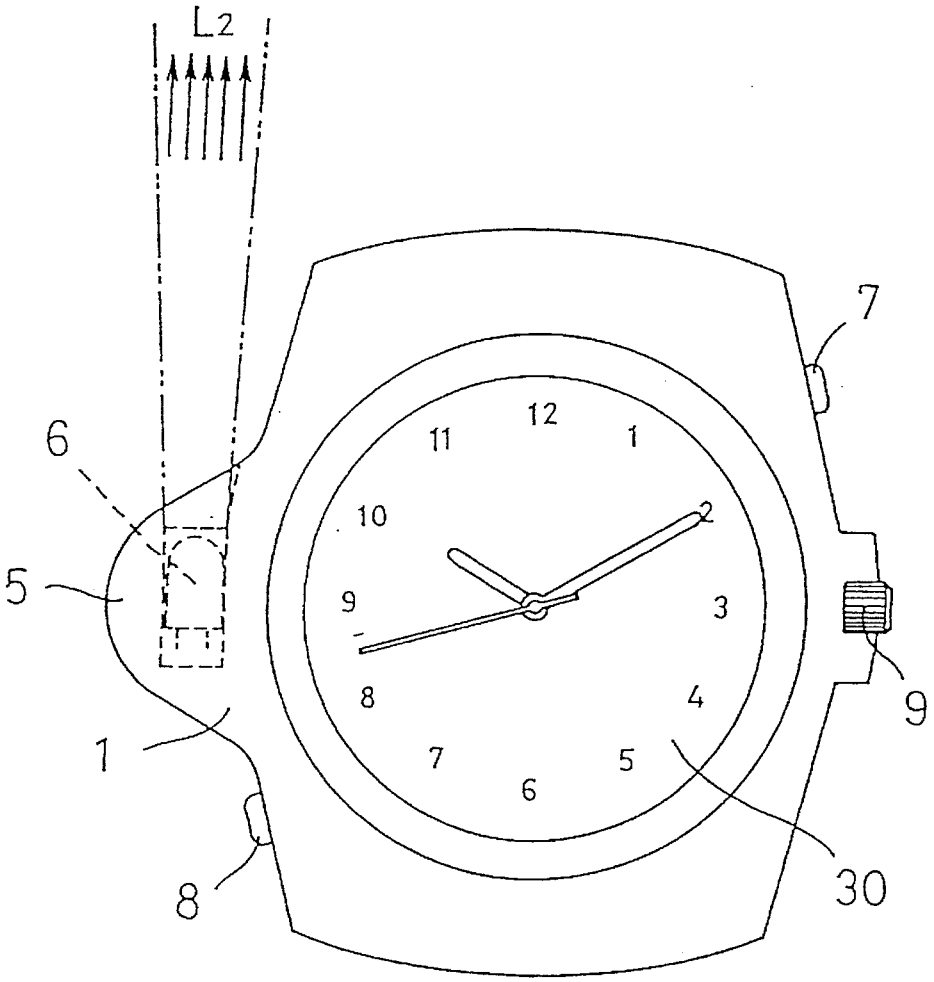
FIG. 7 is a front view of a wrist watch body according to the second embodiment of the present invention.

FIG. 7 is a front view of a wrist watch body according to a second embodiment of the present invention and it is to be noted that the members which are equivalent to those of the first embodiment are denoted by the same reference numerals as the latter and not described in detail hereinafter.

In FIG. 7, the only portion in which the second embodiment is different from the first embodiment is that a luminous body consisting of an EL device is used to illuminate the dial. As shown in the enlarged sectional view of the dial portion of FIG. 8, the dial 30 of analog indication type is made of transparent material. A light-emitting surface of a conventional EL luminous body 31 is attached to the reverse side of the dial 30. The EL luminous body is constructed to sandwich the luminous body,which includes special fluorescent material in dielectric substance, by two sheets of electrodes.

Figure 9:
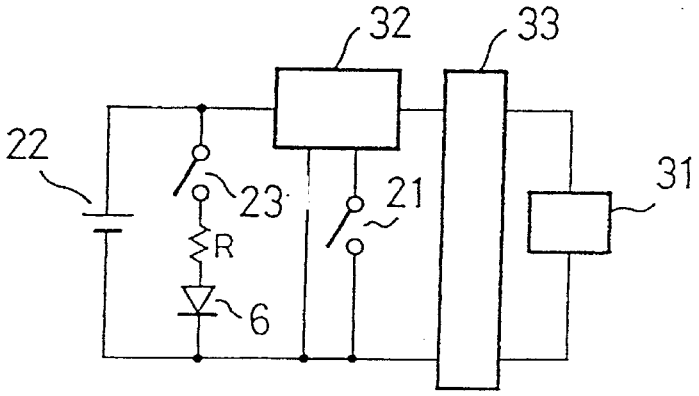
FIG. 9 is a circuit diagram showing one example of a drive circuit for a LED and an EL luminous body according to a second embodiment.

FIG. 9 shows one example of the drive circuit for said LED and EL luminous body, in which the EL luminous body 31 is connected to the battery 22 through a timer 32 for controlling ON-time of light-emitting operation, an inverter 33 for converting a direct-current voltage of the battery 22 to an alternating voltage, and a first switch 21, while the LED 6 for illuminating the outside object is connected through a second switch 23 to the battery 22.

Figure 10:
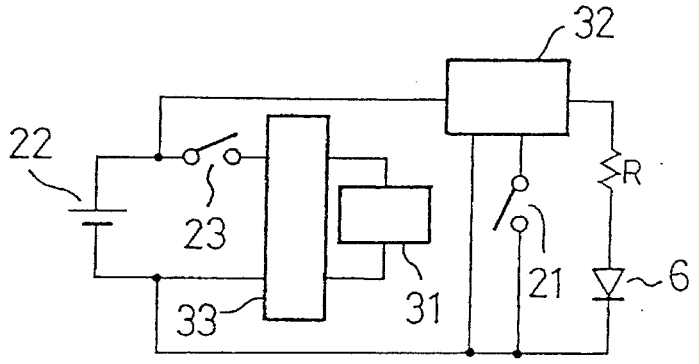
FIG. 10 is a circuit diagram showing another example of the drive circuit for the LED and the EL luminous body according to the second embodiment.
Figure 11:
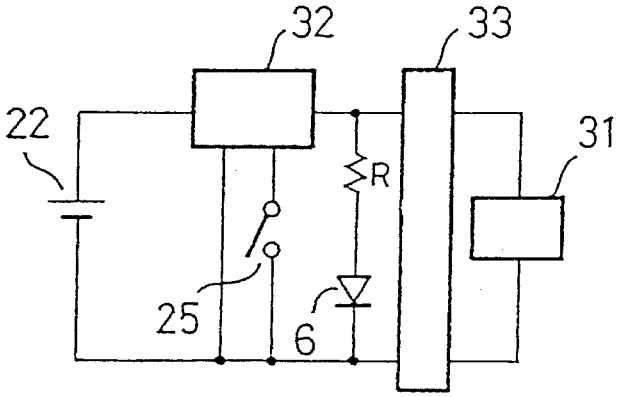
FIG. 11 is a circuit diagram showing a further example of the drive circuit for the LED and the EL luminous body according to the second embodiment.

FIGS. 10 and 11 show another example of the drive circuit for LED and EL luminous body. In the drive circuit of FIG. 10, the EL luminous body 31 is connected through a second switch 23 and an inverter 33 to a battery 22, while the LED 6 for illuminating the outside object is connected through a timer 32 and a first switch 21 to battery 22.

In the drive circuit of FIG. 11, the LED 6 and the EL luminous body 31 connected to an inverter 33 are connected to battery 22 through a common timer 32 and a common switch 25.

In both first and second embodiments, the LED 6 for illuminating the outside object is switched on by pressing one of a pair of outer switch buttons 7 and 8, or by pressing an outer switch button connecting to the common switch 25. With the light-emission by the ON-operation of this LED 6, the emitted light $L_2$ is adapted to directly illuminate the object so that it is possible to make the illumination smooth in the dark with the help of the high-luminance characteristic. Generally, colors such as red, yellow and green are available in the LED, but the yellow color is best in visible effect.

When the timer 20 is connected to the LED 6 for illuminating the outside object, the emitted light can be maintained for a certain period of time even if the switch is off.

The dial 2 is illuminated by pressing one of the pair of outer switch buttons 7 and 8, or by pressing the outer switch button connecting to the common switch 25. And the dial 2 is illuminated by switching the LED 4 for illuminating the dial or the EL luminous body 31 on to emit light.

Specifically, in the first embodiment, the light $L_1$ emitted from the LED 4 is guided by the light-guiding plate 3 to be emitted from the end surface of the horizontal portion 3*a* and then the light $L_1$ illuminates the dial 2.

Figure 8:
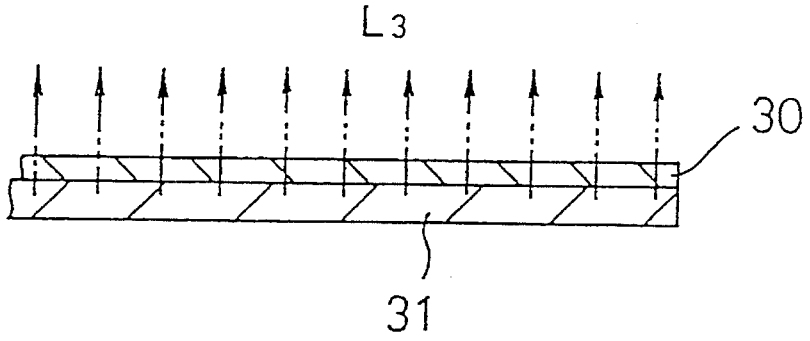
FIG. 8 is an enlarged sectional view of a dial portion of the wrist watch shown in FIG. 7.

On the other hand, in the second embodiment, when the EL luminous body 31 emits the light, as shown in FIG. 8, the emitted light $L_3$ passes through the dial 30 to illuminate the entire surface thereof.

When the timer 32 is connected to the LED 4 for illuminating the dial or the EL luminous body 31, the emitted light can be maintained for a certain period of time even if the LED 4 is switched off.

Figure 12:
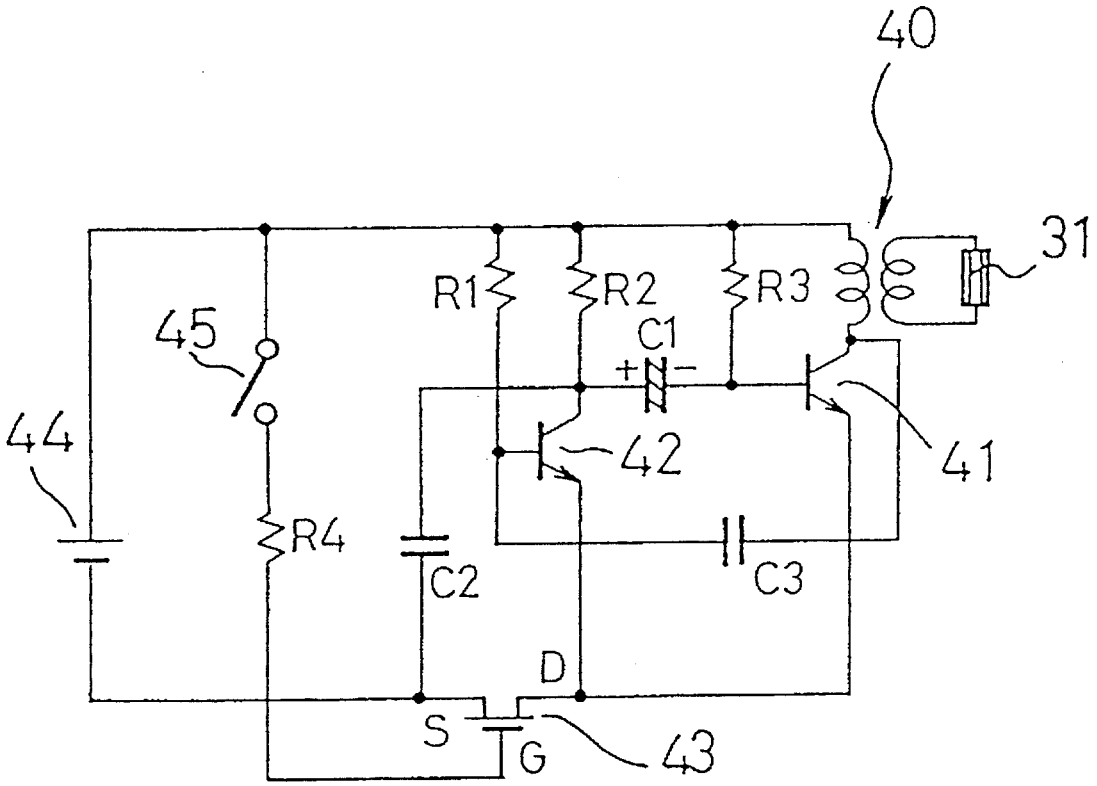
FIG. 12 is a circuit diagram showing another example of the drive circuit for the EL luminous body.

FIG. 12 shows a drive circuit for the EL luminous body, in which reference numeral 40 is a transformer, the secondary side of which is connected to the EL luminous body 31. Reference numerals 41 and 42 are the first transistor and the second transistor which are connected to a drain D of MOS·FET 43 in common with the emitter and form an inverter circuit. Numeral 44 is a battery, the minus side of which is connected to a source S of the MOS·FET 43 and numeral 45 is a switch which is connected between a gate G of the MOS·FET 43 and the plus side of the battery 44. Reference symbols $R_1$ through $R_4$ are resistors and letters $C_1$ through $C_3$ are capacitors.

In FIG. 12, when the switch 45 is closed, the voltage is applied to the gate of the MOS·FET 43 to produce the ON state there and both transistors 41 and 42 are operated to oscillate the circuit, thereby emitting the light. Even if the switch 45 is off under this condition, the drive gate current of the MOS·FET 43 is very small (several μA) and the ON state can be maintained for several seconds and it is possible make the EL luminous body produce the light and the timer function is effected.

To prevent the consumption of the battery in a wait state that the EL luminous body 31 does not emit light, it is desirable to make the current substantially zero when the switch is not on. According to the present embodiment, when the MOS·FET 43 is off, both transistors 41 and 42 stop their operation after a certain period of time and it is possible to make the current of the battery in a wait state substantially zero and prolong the life of the battery.

Thus, according to the drive circuit of FIG. 12, it is possible to provide an EL light-emitting circuit which is simple in operation, low cost in construction and has a timer function therein. It is to be noted that the time for the timer can be further prolonged by connecting the capacitor between the gate and source of the MOS·FET 43.

As described above, with the timepiece device according to the present invention, an outside object in the dark can be illuminated more intensely and made visible to the user by using the LED of high-luminance and high directivity.

It is further possible to emit the light from the LED in the most desirable illuminating condition without hindrance and in various use conditions.

In addition to the above, it is possible to illuminate the dial by the LED for illuminating the same and to read the time easily even in the dark.

Also, it is possible to maintain the time of the LED for illuminating the outside object and for illuminating the dial for a certain period of by the timer.

Since both LEDs are switched on or off by one switch, it is possible to simplify the construction.

Also, since the entire area of the dial can be illuminated by the EL luminous body, it is superior in illuminating effect.

It is further possible to maintain the time of the LED for illuminating the outside object or the time of the EL luminous body for illuminating the dial for a certain period by the timer.

Since said LED and EL luminous body are switched on or off by one switch, it is possible to simplify the construction.

Since the two transistors forming the inverter circuit for driving the EL are switched on or off by the MOS·FET, it is possible to realize the timer function for the EL light emission by providing a simple and low cost circuit composition.

What is claimed is:

1. A timepiece device comprising a watch case, a dial face mounted in said case, said dial face having indices representing hours of the day, first illumination means in said case for illuminating said dial face, and second illuminating means in said case for producing a light beam extending from said case to illuminate external objects, said second illuminating means comprising an LED mounted in a cavity provided in said case outside said dial face adjacent to a 9 O'clock position on said dial face, said LED being disposed in said cavity substantially parallel to said dial face and with an orientation in which an axis of said LED extends substantially parallel to a line passing through the 12 and 6 O'clock positions of the dial face such that said light beam extends from said case substantially parallel to said line passing through the 12 and 6 O'clock positions of the dial face in a direction from said 6 O'clock position to said 12 O'clock position.

2. A timepiece device according to claim 1, wherein said cavity confines said LED and said light beam so that the latter is relatively narrow and has a divergence of the order of several degrees.

3. A timepiece device according to claim 1, wherein said LED and said dial face are substantially coplanar.

4. A timepiece device according to claim 1, comprising an on-off switch for said LED, said on-off switch being located in said case outside said light beam.

5. A timepiece device according to claim 1, wherein said first illumination means comprises a further LED and a light guiding member for guiding light emitted by said further LED onto said dial face, said further LED and light guiding member being located at a peripheral portion of said dial face.

6. A timepiece device according to claim 5, wherein said light guiding member covers said further LED from above and laterally illuminates said dial face.

7. A timepiece device according to claim 5, comprising a timer for controlling on-time of at least one of said LEDs.

8. A timepiece device according to claim 7, comprising a separate on-off switch for each of said LEDs.

9. A timepiece device according to claim 7, comprising a common switch for said LEDs.

10. A timepiece device according to claim 1, wherein said first illumination means comprises an electroluminescent device including an electroluminescent layer, said dial face being light transmissive and having a rear face at which said eletroluminescent layer is secured.

11. A timepiece device according to claim 10, comprising a timer for controlling on-time of at least one of said LED and said electroluminescent device.

12. A timepiece device according to claim 10, comprising a separate on-off switch for said LED and said electroluminescent device.

13. A timepiece device according to claim 10, comprising a common switch for said LED and said electroluminescent device.

14. A timepiece device according to claim 10, comprising a drive circuit for said electrolumiscent device, said drive circuit including an inverter circuit an MOS-FET and a battery.

15. A timepiece device according to claim 14, wherein said inverter circuit comprises two transistors having emitters connected to a drain of said MOS-FET, said battery having a minus side connected to a source of said MOS-FET and a plus side connected through a switch to a gate of said MOS-FET.

* * * * *